United States Patent [19]

Sato et al.

[11] 4,212,783

[45] Jul. 15, 1980

[54] PAPER SIZES

[75] Inventors: Hisatake Sato; Shiroh Saitoh, both of Yokohama; Michihiro Mohri, Kawasaki; Akio Miyahara, Tokyo; Hideo Hayashi, Yokohama, all of Japan

[73] Assignee: Nippon Oil Co., Ltd., Tokyo, Japan

[21] Appl. No.: 928,486

[22] Filed: Jul. 27, 1978

[30] Foreign Application Priority Data

Aug. 3, 1977 [JP] Japan ..... 52-92508

[51] Int. Cl.[2] ..... C08F 8/12; C08F 8/46

[52] U.S. Cl. ..... 260/29.6 H; 260/29.6 E; 260/29.6 N; 525/386; 526/272; 526/290; 526/317; 526/338

[58] Field of Search ..... 526/56, 272, 290, 317; 525/386; 260/29.6 H, 29.6 E, 29.6 N

[56] References Cited

U.S. PATENT DOCUMENTS

| | | | |
|---|---|---|---|
| 3,953,407 | 4/1976 | Hayashi et al. | 526/56 |
| 4,071,581 | 1/1978 | Yokoyama | 526/56 |
| 4,080,493 | 3/1978 | Yasui et al. | 526/56 |
| 4,152,312 | 5/1979 | Sackmann et al. | 526/272 |
| 4,161,571 | 7/1979 | Yasui et al. | 526/272 |

*Primary Examiner*—William F. Hamrock
*Attorney, Agent, or Firm*—Frank J. Jordan

[57] ABSTRACT

A paper size obtained by the steps of treating with an acid a hydrocarbon distillate boiling within the range of 20°-80° C. and containing at least one $C_5$ acyclic conjugated diolefin in an amount of 10 to 35 wt. % of the distillate, the distillate being derived from a fraction obtained as a by-product at the time of cracking petroleum, reacting said hydrocarbon distillate with an $\alpha,\beta$-unsaturated carboxylic acid in a specified weight ratio and then saponifying the thus obtained acid-modified hydrocarbon distillate with an alkali thereby to obtain the paper size.

8 Claims, No Drawings

PAPER SIZES

This invention relates to paper sizes and more particularly to synthetic paper sizes which are cheap, more satisfactory in sizing effect than natural rosin-based sizes and less foamy than other synthetic sizes when in use.

Sizes made from natural rosin or modified ones are now in wide use, but the price of such sizes tends to fluctuate depending on the quantity thereof demanded and supplied since rosin is a naturally occurring material. For this reason, various studies have heretofore been made in attempts to produce synthetic sizes or sizing agents which may be substituted for rosin. For example, petroleum resins produced from $C_5$ and $C_9$ fractions or mixtures thereof, the fractions being obtained from cracked naphtha, are reacted with maleic anhydride to obtain a product for use as a size (Japanese Patent Gazettes Nos. 3590/63, 9521/65, 15641/68, 30107/70, etc.). In the inventions of these Patent Gazettes, thermoplastic resins having a softening point of 30° C. or higher may frequently be used. Synthetic resins which are more excellent in sizing performance than rosin have been attempted to be produced, for example, by using petroleum resins having different softening points respectively or by modifying maleinised petroleum resins in various manners, but these attempts are not yet successful. On the other hand, there is known an alkylsuccinic or alkenylsuccinic acid as a synthetic size different from a petroleum resin (Japanese Patent Gazette No. 565/65). The water soluble salts of alkylsuccinic or alkenylsuccinic acid have some sizing effect but they are very disadvantageous because of their foamability (foaming property) thereby raising problems when in practical use. An alkylsuccinic or alkenylsuccinic acid (not in the form of soluble salt) otherwise be used in aqueous dispersion form by adding a dispersant thereto (Japanese Patent Gazette No. 2305/64); in this case, the foamability of the dispersion is less problematic or troublesome but a problem of storage stability of the dispersion is raised because of its poor water solubility thereby requiring, for example, cleaning of tanks for storage thereof.

After intensive studies had been made by the present inventors in an attempt to develop less expensive sizes which will not foam when in use, is excellent in storage stability and is higher in sizing performance than natural rosin-based sizes or conventional synthetic sizes, it has been found that new satisfactory sizes may be obtained as follows. The new sizes of this invention may be obtained by treating with an acid a distillate contained in a fraction boiling within the range of 20°-80° C. and containing $C_5$ acyclic conjugated diolefins in an amount of 10 to 35 wt.% of the distillate, the fraction being obtained as a by-product by, for example, thermocracking, steam cracking or catalytically cracking petroleum, to obtain a hydrocarbon distillate boiling within the range of 170°-400° C., preferably 185°-350° C., reacting 100 parts by weight of the thus obtained hydrocarbon distillate with 25-80 parts by weight of an $\alpha,\beta$-unsaturated carboxylic acid and then saponifying the resulting reaction product with an alkali thereby to obtain a size exhibiting excellent sizing performance.

This invention is characterized by using as the starting material a hydrocarbon distillate obtained by treating with an acid a distillate contained in a fraction boiling within the range of 20°-80° C. and containing at least one $C_5$ acyclic conjugated diolefin in an amount of 10 to 35% by weight of the distillate, the fraction being obtained as a by-product by, for example, thermocracking, steam cracking or catalytically cracking petroleum. It is necessary that the starting oil according to this invention should contain acyclic conjugated diolefins having 5 carbon atoms. These acyclic conjugated diolefins include isoprene, trans-1,3-pentadiene, cis-1,3-pentadiene and mixtures thereof. It is also necessary that the acyclic conjugated diolefins should be contained in an amount of 3-100% by weight of all the unsaturated components in the starting oil. The term "all the unsaturated components" used herein is intended to mean all the monoolefins and diolefins contained in the starting oil, and these unsaturated components include the acyclic conjugated diolefins, cyclopentadiene, dicyclopentadiene, 1,4-pentadiene, 1-pentene, trans-2-pentene, cis-2-pentene, 2-methyl-1-butene, 2-methyl-2-butene, 3-methyl-1-butene and cyclopentene.

In this case, the unsaturated components in the starting oil may be one or more of the aforesaid ones. For instance, the unsaturated components may be acyclic conjugated diolefins only or may be a mixture thereof with at least one of cyclopentadiene, dicyclopentadiene, 1,4-pentadiene, 1-pentene, trans-2-pentene, cis-2-pentene, 2-methyl-1-butene, 2-methyl-2-butene, 3-methyl-1-butene and cyclopentene with the proviso that the unsaturated components contain the at least one acyclic conjugated diolefin in an amount of at least 3% by weight thereof.

These unsaturated components may also be obtained by further cutting a fraction boiling in the range of 20°-80° C. by distillation.

If the unsaturated or polymerizable components contain less than 3% by weight of the acyclic conjugated diolefins, based on the total weight thereof, and a starting oil containing such an amount of unsaturated components is treated with an acid to obtain a product, the fraction boiling at higher than 250° C. of the thus obtained product will exhibit low sizing performance thereby rendering the fraction unsuitable as a material for size, while a size synthesized using as the starting oil the fraction boiling within the range of 170°-250° C. of said product will exhibit sizing performance to some extent but simultaneously exhibit foamability.

In contrast, if the starting oil contains at least one acyclic conjugated diolefin in an amount of at least 3% by weight of all the unsaturated components in the starting oil and it is treated with an acid to obtain a product, the fraction boiling within the range of 170°-400° C., preferably 185°-350° C., of the thus obtained product will be particularly excellent as a material for a size exhibiting high sizing performance and a size synthesized from said product as the acid-treated starting oil has been found to have very low foamability. As mentioned before, the use of a starting oil containing the at least one acyclic conjugated diolefin in an amount of less than 3% by weight of all the polymerizable components in the starting oil will not result in the production of a satisfactory size of this invention. If the starting oil contain cyclopentadiene or dicyclopentadiene which is a derivative of the former, the use thereof will tend to result in the production of a less satisfactory size. Because of the high reactivity of cyclopentadiene or dicyclopentadiene, the acid-treatment of the starting oil containing cyclopentadiene or dicyclopentadiene and at least one acyclic conjugated diolefin will tend to produce a hydrocarbon distillate in which the oil portion boiling within the higher temperature range has been increased, whereby a yield of the desirable oil portion boiling within the range of 170°–400° C. may decrease. In such a case, it is preferable to remove the cyclopentadiene and dicyclopentadiene from the starting oil by heat treatment or the like prior to the acid-treatment from the view-point of economy and/or effective use of hydrocarbon resources.

The starting oil according to this invention is a $C_5$ distillate which is obtained by the thermocracking, steam cracking or catalytic cracking of petroleum (the distillate being a hydrocarbon mixture boiling within the continuous range of about 20° C. to about 80° C. and the distillate being obtained by distilling the cracked oil so as to substantially remove therefrom $C_4$ or lighter hydrocarbons as well as $C_6$ (benzene) or heavier hydrocarbons) and which contains 10–35%, preferably 15–30% by weight of acyclic conjugated diolefins. The starting oil may preferably be a hydrocarbon mixture obtained by removing the cyclopentadiene and dicyclopentadiene from the said $C_5$ distillate.

The acid treatment according to this invention may be effected using a known acid. The known acids used herein include various Brønsted acids and Lewis acids. These acids may of course be in liquid or solid form or may be supported on a solid carrier. They may also be used in solution in water, an alcohol, ether or phenolic compound or may further be used in the form of a complex compound in which the acid has been addition reacted. Typical of these acids are phosphoric acid, sulphuric acid, hydrogen fluoride, aluminum halide, boron trifluoride, zinc chloride, titanium chloride, silica, alumina, silica alumina, crystalline aluminosilicate, clay and highly acidic cation exchange resins; among which are preferred boron trihalides such as boron trifluoride, the complex compounds thereof with water, alcohol, ether and a phenolic compound, and phosphoric acid without or together with alumina, silica alumina, silica or like solid carrier on which the phosphoric acid is supported. The acid treatment is effected under such conditions that the product to be obtained by the acid treatment contains a fraction boiling within the range of 170°–400° C. in the possible largest amount. The optimum reaction temperature varies depending on the kind and concentration of the acid used as well as on the kind of the carrier used, and it may preferably be in the range of −20° to 220° C.

It has further been found by the present inventors that an effective product as the hydrocarbon distillate, may be obtained in a good yield by treating the starting oil with a boron trihalide or the complex compound thereof as the acid at 60°–180° C. or with phosphoric acid or the like as the acid at 80°–200° C. The acid treatment may be effected batchwise or continuously.

This invention is characterized by using a low boiling hydrocarbon distillate boiling within the range of 170°–400° C., preferably 185°–350° C., and being obtained from the aforesaid acid-treated starting oil. There are many known publications which disclose the use of petroleum resins, as a material for sizes, however, none of them disclose the use of such a low boiling distillate as disclosed by the present invention even though the said known petroleum resins be liquid ones. For instance, there is a known process in which is used a petroleum resin having a softening point of lower than 40° C. obtained by polymerizing a mixture containing a $C_4$–$C_5$ olefinic distillate and dicyclopentadiene (Japanese Patent Application Laying-Open Gazette No. 19104/74), however, such a petroleum resin is different from the low boiling hydrocarbon distillate according to the present invention.

Further, the hydrocarbon distillate with the aforesaid boiling range according to this invention has a freezing point of about −20° C. or lower and, therefore, it is clearly differentiated from the conventional petroleum resins having so-called usual softening point. The aforesaid Japanese Patent Application Laying-Open Gazette No. 19104/74 discloses that the petroleum resin obtained is maleinised and further reacted with ammonia, urea or the like to be converted to the corresponding acid imide thereby obtaining a satisfactory size; on the other hand, in the case of using the specified hydrocarbon distillate obtained by acid-treating the starting oil, such conversion to an acid imide is not required but saponification with an alkali is required thereby obtaining an excellent size. This also proves that the petroleum resin having a softening point of lower than 40° C. as used in the said Japanese Laying-Open Gazette is clearly different from the specified hydrocarbon distillate obtained by the acid treatment of the starting oil according to the present invention. In addition, a liquid polymer having a number average molecular weight of 500–10,000 obtained by cationically reacting 1,3-pentadiene or the like in the presence of a homogeneous Friedel-Crafts type catalyst, is disclosed in Japanese Patent Application Laying-Open Gazette of 25103/77, however, this Gazette neither teaches nor suggests the use of such a low boiling distillate as used in the present invention and it describes that the use of a liquid polymer having a molecular weight of less than 500 will result in the production of a size exhibiting decreased sizing performance.

It has been found by the present inventors that in a distillate obtained by the acid treatment of the starting oil, the use of the portion of the distillate boiling at lower than 170° C. will result in producing a product exhibiting hardly any sizing performance, the use of the portion thereof boiling at at least 170° C. a size exhibiting satisfactory sizing performance, the use of the portion thereof boiling at 185°–350° C. a size exhibiting remarkable sizing performance, the use of the portion thereof boiling at higher than 350° C. a size exhibiting still satisfactory sizing performance with the proviso that the sizing performance obtained will gradually be lowered as the boiling point of an oil used is higher, and the use of the portion thereof boiling above 400° C. a product exhibiting unsatisfactory sizing performance. In this case, the hydrocarbons of the distillate portions boiling within the range of 170°–400° C. have a molecular weight of about 160 to about 390. This fact appears prima facie to be inconsistent with the aforesaid fact that in the case of using as a material for sizes a liquid polymer obtained by the polymerization of 1,3-pentadiene (Japanese Patent Application Laying-Open Gazette No. 25103/77), the use of the liquid polymer having a molecular weight of lower than 500 will result in the production of a product exhibiting poor sizing performance. This prima-facie inconsistency is due to the fact that an excellent size would not be obtained in the case of the invention of said Japanese Gazette since the ethylenically unsaturated carboxylic compound is addition reacted with the liquid polymer in a very small amount of 0.1 to 15 parts by weight per 100 parts by weight of the liquid polymer as is clear from the specification of said Japanese Gazette, and that in said Gazette there would not be used such a distillate having a very low molecular weight and boiling within the range of 170° to 400° C., preferably 185° to 350° C., as used in the present invention in order to obtain a size.

Further, said Gazette discloses that the size obtained is essentially required to be used together with a rosin-based compound in order to exhibit very excellent sizing performance, while the size of the present invention may exhibit very excellent sizing performance without using the rosin-based compound together therewith. This will further indicate that the liquid polymer according to said Gazette and the low boiling hydrocarbon distillate are clearly different from each other.

If a hydrocarbon distillate containing hydrocarbons boiling below 170° C. is used as the material for a size, then the resulting size will exhibit low sizing performance; as the content of such low boiling hydrocarbons increases, the sizing performance will decrease. On the other hand, the use of a hydrocarbon distillate boiling above 400° C. as the material for a size will produce a product exhibiting hardly any sizing performance. Thus, it is not necessary in this invention that a distillate portion boiling below 170° C. or above 400° C. be present in the hydrocarbon distillate according to this invention, however, it is undesirable but may be allowed if a relatively small amount of these low or high boiling distillate portions be left in said hydrocarbon distillate after the operation of recovery of the distillate portion boiling within the range of 170°–400° C. from the acid-treated starting oil.

Further, in this invention, the acid-treated starting oil is distilled usually under atmospheric or reduced pressure to obtain a hydrocarbon distillate boiling within the specified temperature range (170°–400° C.), however, the acid-treated starting oil may be used either as it is or after the removal of the unreacted portion of the starting oil if this treated starting oil is such that hydrocarbons boiling within the specified temperature range are obtainable therefrom selectively and in a good yield.

This invention is further characterized by addition reacting 100 parts by weight of the hydrocarbon distillate boiling within the range of 170°–400° C. with 25–80 parts by weight of an $\alpha,\beta$-unsaturated carboxylic acid. The $\alpha,\beta$-unsaturated carboxylic acids usually have 4–20 carbon atoms and include maleic, fumaric, citraconic and itaconic acids, maleic and citraconic anhydrides, and acrylic and methacrylic acids, with maleic anhydride being the most preferable. The reaction between the hydrocarbon distillate and the $\alpha,\beta$-unsaturated carboxylic acid may be effected in the same manner as in addition reaction between usual unsaturated hydrocarbons and such acids. The addition reaction according to this invention may be carried out at, for example, 100°–260° C. in the presence or absence of reaction accelerators such as peroxides, and diluents. Many of the hydrocarbon distillates obtained by acid treating the starting oil according to this invention have at least one unsaturated double bond per molecule of hydrocarbon and, thus, they may easily and substantially entirely be reacted with the $\alpha,\beta$-unsaturated carboxylic acid in a relatively short time. If the amount of the $\alpha,\beta$-unsaturated carboxylic acid addition reacted is less than 25 parts by weight per 100 parts by weight of the hydrocarbon distillate, then the thus addition reacted hydrocarbon distillate after saponification with an alkali, will not produce a uniform and transparent aqueous size solution but it will produce an aqueous size solution which has low storage stability and is unsuitable for practical use as a size. In this case, a uniform and transparent size may be obtained by allowing an oily separated matter hindering the uniformity to stand or centrifugalize it in order to remove it, the oil separated matter being a portion of the hydrocarbon distillate which was not reacted with the $\alpha,\beta$-unsaturated carboxylic acid.

If an oily separated matter-free size composition contains an $\alpha,\beta$-unsaturated carboxylic acid units in the same amount as a size obtained by addition reacting 100 parts by weight of the hydrocarbon distillate with 25–80 parts by weight of the $\alpha,\beta$-unsaturated carboxylic acid, such a size composition is within the scope of this invention. On the other hand, the use of more than 80 parts by weight of the $\alpha,\beta$-unsaturated carboxylic acid will result in the production of a product exhibiting decreased sizing performance, this being undesirable.

The hydrocarbon distillate so reacted with the carboxylic acid is then saponified with an alkali to form a water soluble salt. The salt so formed may be very easily dissolved in water to produce a transparent solution. Even if the solution is once evaporated to dryness, the dry matter so obtained will rapidly be redissolved into a transparent solution by adding thereto water or a solution of the size of this invention. Because of this, said solution is excellent in storage stability. The reaction product of the hydrocarbon distillate and $\alpha,\beta$-unsaturated carboxylic acid may be dispersed as it is with a dispersant in water for use as a size, however, the size so obtained is unsuitable for practical use because of lack in storage stability. The reaction product may be partly saponified so long as its storage stability is not impaired and, in this case, there is no effect on sizing performance.

The adduct with the $\alpha,\beta$-unsaturated carboxylic acid is incorporated with an aqueous solution of an alkali for saponification thereof; in this case, the alkali may preferably be used in an amount of approximately the same mol as the carboxylic acid units contained in the adduct or may also be used in an amount of about 40 to 150% of the carboxylic acid units.

The amount of water to be contained in the aqueous alkali solution is not particularly limited, however, the water may be used in such an amount that the solid matter in the resulting size is present therein in a concentration of about 1–80%, preferably 3–50%, by weight.

The alkalies used herein include usual alkalies such as sodium hydroxide, potassium hydroxide, ammonia water and water soluble amines, with sodium hydroxide and potassium hydroxide being preferred.

The sizes of this invention exhibit more satisfactory sizing performance than rosin-based sizes and have excellent storage stability without foamability. In addition, they are produced at a low cost, this being one of the features thereof. Since the boiling range of the hydrocarbon distillate for a size, obtained from the acid-treated starting oil is as broad as 170°–400° C., the effective components, that is, said distillate may be obtained in a high yield. In the known processes for the production of petroleum resin-derived sizes exhibiting improved sizing performance, it is customary that a petroleum resin is reacted with maleic anhydride and the resulting maleinised petroleum resin is subjected to modification such as reaction with urea (Japanese Patent Gazette No. 5723/70), amination (Japanese Pat. Appln. Laying-Open Gazette No. 19104/74), decarboxylation (Japanese Pat. Appln. Laying-Open Gazette No. 25806/75) or the like; on the other hand, the process according to this invention gives a size exhibiting satisfactory sizing performance without requiring such a modification and it is advantageously a simple one as compared with said known processes for the production of the petroleum resin-derived sizes.

The size of this invention may be used alone as a satisfactory one or jointly with the known rosin-based size and/or petroleum resin-derived size as a mixed size retaining the features of the size of this invention.

The size of this invention may be handled and used in quite the same manner as the known rosin-based size and it is usually added to a pulp slurry and fixed with alum. It may also be used as a surface sizing agent.

This invention has so far been described with respect to the utility and usefulness of the size and will be better understood by the following examples in which all parts and percentages are by weight unless otherwise specified.

EXAMPLE 1

A fraction boiling within the range of 20°-80° C. obtained as a by-product by the steam cracking of naphtha, was heated to 100° C. for 4 hours, treated to thermally dimerize the greater part of the cyclopentadiene contained in said fraction to dicyclopentadiene and thereafter distilled thereby to obtain a fraction boiling within the range of 20°-80° C. (this fraction being found by gas chromatography to contain isoprene 9.1%, piperylene 12.4%, cyclopentadiene 0.6% and monoolefins 25.2%). Eight hundred (800) grams of the thus obtained fraction boiling in the range of 20°-80° C. and 50 g of a phosphoric acid-on-diatomaceous earth catalyst (the content of phosphoric acid: 30%) were introduced into a 2-liter autoclave where the fraction was treated with the acid at 120° C. for 50 minutes. The whole mass from the autoclave was filtered to remove the catalyst therefrom and the remainder was further distilled to obtain 168 g of a hydrocarbon distillate boiling within the range of 185°-320° C. and having a number average molecular weight of 223 and a bromine value of 127. Then, 100 parts of the thus obtained hydrocarbon distillate were addition reacted with 45 parts of maleic anhydride at 210° C. with agitation for 6 hours under a nitrogen atmosphere to obtain a reaction product or an adduct having an addition ratio of 98%. The thus obtained adduct which had a saponification value of 382, was incorporated with water and potassium hydroxide in an amount approximately equivalent to said saponification value to form a mixture which was saponified at 80°-90° C. under agitation thereby to obtain a transparent size having a solids content of 30%. The size so obtained had a pH value of 10.3.

COMPARATIVE EXAMPLE 1

Commercially available dodecenylsuccinic anhydride was saponified in the same manner as in Example 1 to obtain a transparent size.

COMPARATIVE EXAMPLE 2

Sixty-eight (68) grams of a hydrocarbon distillate boiling within the range of 145°-165° C. was obtained from the reaction product of the fraction boiling within the range of 20°-80° C. and the phosphoric acid-diatomaceous earth catalyst as produced in Example 1. Then, 100 parts of the thus obtained hydrocarbon distillate were reacted with 60 parts of maleic anhydride in the same manner as in Example 1 to obtain a reaction product having a saponification value of 430. The reaction product so obtained was saponified in the same manner as Example 1 to obtain a transparent size having a solids content of 30% and a pH value of 10.4.

COMPARATIVE EXAMPLE 3

Fifty-five (55) grams of a hydrocarbon distillate boiling above 400° C. (bottom oil) were obtained from the reaction product of the fraction boiling within the range of 20°-80° C. and the phosphoric acid-diatomaceous earth catalyst as produced in Example 1. The hydrocarbon distillate so obtained had a number average molecular weight of 590 and a bromine value of 49. One hundred (100) parts of the thus obtained hydrocarbon distillate were reacted with 25 parts of maleic anhydride in the same manner as in Example 1 to obtain a reaction product having a saponification value of 174. This reaction product was saponified in the same manner as in Example 1 to obtain a transparent size having a solids content of 30% and a pH value of 10.2.

EXAMPLE 2

The sizes obtained in Example 1 and Comparative examples 1-3 were tested for their sizing performance with the results being shown in Table 1.

The test conditions were as follows.

Pulp: LBKP Degree of beating 40° SR

Basis weight: 60 g/m$^2$

Amount of size added: (Weight of solid matter of size/Weight of absolutely dried pulp)×100%

Water for fixing: Mixture of sea water and deionized water in the ratio by weight of 1:9

Method for fixing: Adjusted to a pH value of 4.5 by addition of alum

Water for dilution: Adjusted to a pH value of 5.0 by addition of an aqueous alum solution to tap water Paper-making machine: TAPPI Standard machine Drying: Dried at 105° C. by the use of a drum dryer Method of test for sizing performance: JIS P-8122 Stöckigt method Table 1

| Size | Amount of size added (wt.%) 0.5 | 1.0 | Foaming at the time of dilution (paper making) |
|---|---|---|---|
| Example 1 | 29 sec. | 41 sec. | None |
| Comparative example 1 | 24 sec. | 37 sec. | Some |
| Comparative example 2 | 0 sec. | 0 sec. | — |
| Comparative example 3 | 0 sec. | 1-2 sec. | — |
| Commercially available fortified rosin-based size | 16 sec. | 34 sec. | None |

As shown in Table 1, the size of this invention exhibited more excellent sizing performance than the commercially available fortified rosin-based size and further than the alkenylsuccinic acid size (Comparative example 1). Further, the size of this invention exhibited entirely no foaming, while the alkenylsuccinic acid size (Comparative example 1) were appreciated to generate ten and several foams.

In addition, the hydrocarbon distillates (Comparative examples 2 and 3) boiling outside the temperature range according to this invention were found to exhibit hardly any sizing performance or effect.

EXAMPLE 3

A 2-liter autoclave was charged with 360 g of 1-pentene, 20 g of isoprene, 20 g of trans-1,3-pentadiene, 400 g of n-pentane and 50 g of a phosphoric acid-diatomaceous earth catalyst to form a mixture which was then reacted together at 120° C. for 50 minutes. The resulting reaction mixture was freed from the catalyst and distilled to obtain 104 g of a hydrocarbon distillate boiling within the range of 170°-300° C. The distillate so obtained had a number average molecular weight of 211 and a bromine value of 97. Then, 100 parts of the thus obtained hydrocarbon distillate were reacted with 50 parts of maleic anhydride in the same manner as in Example 1 to obtain a reaction product or an adduct having an addition ratio of 95% and a saponification value of 358. The adduct so obtained was then saponified in the same manner as in Example 1 to obtain a transparent size containing 30% of solid matter at a pH of 10.2.

COMPARATIVE EXAMPLE 4

Four hundred (400) grams of 1-pentene, 400 g of pentane and 50 g of the same phosphoric acid-diatomaceous earth catalyst as in Example 1 were introduced into a 2-liter autoclave where the resulting mixture was reacted together at 120° C. for 50 minutes, freed from the catalyst and then distilled in the same manner as in Example 1 to obtain 72 g of a hydrocarbon distillate (A) boiling in the range of 170°-250° C. and 42 g of hydrocarbon distillate (B) boiling in the range of 250°-400° C. These distillates (A) and (B) had number average molecular weights of 185 and 315, and bromine values of 88 and 52, respectively. Then, 100 parts of the distillate (A) were reacted with 55 parts of maleic anhydride in the same manner as in Example 1 thereby to obtain a reaction product having a saponification value of 388. The reaction product so obtained was saponified in the same manner as in Example 1 to obtain a transparent size (Comparative example 4-A) having a solids content of 30%. On the other hand, 100 parts of the distillate (B) were reacted with 35 parts of maleic anhydride in the same manner as in Example 3 to obtain a reaction product having a saponification value of 268. The reaction product so obtained was saponified in the same manner as in Example 1 to obtain a transparent size (Comparative example 4-B) having a solids content of 30%.

EXAMPLE 4

The sizes obtained in Example 3 and Comparative example 4 were tested for their sizing performance or effect under the same test conditions as in Example 2. The results are shown in Table 2.

Table 2

| Size | Amount of size added: 0.5 wt. % | Foaming at the time of dilution |
|---|---|---|
| Example 3 | 24 sec. | None |
| Comparative example 4-A | 12 sec. | Some |
| Comparative example 4-B | 0 sec. | — |

As is seen from Table 2, the sizes (Comparative examples 4-A and 4-B) derived respectively from the starting oils containing no acyclic conjugated diolefins are not comparable in sizing performance or effect to the size of this invention. Further, the size (Comparative example 4-A) generated several foams when diluted in paper making, while the size (Example 4) derived from the starting oil containing acyclic conjugated diolefins generated no foams.

EXAMPLE 5

To a 2-liter autoclave were added 800 g of a fraction boiling within the range of 20°-80° C. (this fraction being found by gas chromatography to contain isoprene 14.0%, piperylene 9.2%, cyclopentadiene 14% and monoolefins 22.0%) obtained as a by-product by steam cracking naphtha and 50 g of a commercially available phosphoric acid-diatomaceous earth catalyst to form a mixture which was reacted together at 100° C. for 30 minutes, filtered with filter paper to remove the catalyst and then distilled thereby to obtain 122 g of a hydrocarbon distillate boiling in the range of 185°-350° C. and having a number average molecular weight of 238 and a bromine value of 124. Then, 100 parts of the hydrocarbon distillate so obtained were addition reacted under agitation with 45 parts of maleic anhydride at 210° C. for 6 hours in a nitrogen atmosphere to obtain a reaction product having an addition ratio of 97% and a saponification value of 379. The reaction product so obtained was then incorporated with water and potassium hydroxide in an amount approximately equivalent to said saponification value and saponified at 80°-90° C. under agitation to obtain a transparent size having a solids content of 30% and a pH value of 10.2.

The size so obtained was tested for its sizing effect, under the same test conditions as in Example 2. The result is that the sizing effects were 38 and 25 seconds respectively when 1.0% and 0.5% of the size were added.

EXAMPLE 6

Eight hundred (800) grams of the same fraction boiling in the range of 20°-80° C. after the thermal dimerization of the cyclopentadiene contained therein, as in Example 1, were charged into a 2-liter autoclave where the fraction was incorporated with 10 g of boron trifluoride diethyl ether complex compound, reacted together at 140° C. for 30 minutes, incorporated with an aqueous solution of sodium hydroxide to decompose the boron trifluoride complex compound, washed with water and distilled thereby to obtain 166 g of a hydrocarbon distillate boiling in the range of 185°-350° C. The distillate so obtained had a number average molecular weight of 230 and a bromine value of 126. Then, 100 parts of the hydrocarbon distillate were reacted under agitation with 45 parts of maleic anhydride at 180° C. for 10 hours in a nitrogen atmosphere to obtain a reaction product having an addition ratio of 95% and a saponification of 340. The reaction product so obtained was saponified in the same manner as in Example 1 to obtain a transparent size having a solids content of 30% and a pH value of 10.2. This size was tested for sizing effect under the same test conditions as in Example 2 with the result that degrees of sizing were 41 and 30 seconds respectively when 1.0 and 0.5% were added.

EXAMPLE 7

Eight hundred (800) grams of the same fraction boiling in the range of 20°-80° C. after the thermal dimerization of the cyclopentadiene contained therein, as in Example 1, were charged into a 2-liter autoclave where the fraction was incorporated with 8 g of boron trifluoride phenol complex compound, reacted together at 150° C. for 30 minutes and then treated in the same manner as in Example 6 to obtain 55 g of a hydrocarbon distillate (C) boiling in the range of 180°-200° C. and 38 g of a hydrocarbon distillate (D) boiling in the range of 280°-400° C. These distillates (C) and (D) had number average molecular weights of 198 and 328, and bromine values of 142 and 85, respectively. Then, 100 parts of the distillate (C) were addition reacted with 50 parts of maleic anhydride at 200° C. under 10 hours' agitation in a nitrogen atmosphere to obtain a reaction product having an addition ratio of 98% and a saponification value of 368. The reaction product so obtained was saponified in the same manner as in Example 1 to yield a transparent size (Example 7-A) having a solids content of 30% and a pH value of 10.2.

On the other hand, 100 parts of the distillate (D) were addition reacted with 30 parts of maleic anhydride in the same manner as in the case of the aforesaid distillate (C) to yield a reaction product having an addition ratio of 94% and a saponification of 265. This reaction product was saponified in the same manner as in Example 1 to obtain a transparent size (Example 7-B) having a solids content of 30% and a pH value of 10.3.

These sizes so obtained were tested for sizing effect under the same test conditions as in Example 2 with the results being shown in Table 3.

Table 3

| Size | Degree of size when 0.5 wt. % of size added |
|---|---|
| Example 7-A | 25 sec. |
| Example 7-B | 24 sec. |

COMPARATIVE EXAMPLE 5

One hundred (100) parts of the same hydrocarbon distillate (D) boiling in the range of 280°-400° C. as obtained in Example 7 were addition reacted with a small amount (15 parts) of maleic anhydride in the same manner as in Example 7 to obtain a reaction product having an addition ratio of 99% and a saponification value of 132. The reaction product so obtained was subjected to saponification in the same manner as in Example 1 with the result that the reaction product so saponified did not form a uniform and transparent solution even when its pH value reached 10.5. The thus saponified reaction product had very poor storage stability and exhibited no excellent uniform sizing effect, and it was therefore impossible for use as a size.

As is apparent from the foregoing, the use of maleic anhydride in a smaller amount than is used in this invention will not result in the production of an excellent size.

COMPARATIVE EXAMPLE 6

One hundred (100) parts of the same hydrocarbon distillate (C) boiling in the range of 180°-200° C. as obtained in Example 7 were addition reacted with 100 parts of maleic anhydride in the same manner as in Example 7 to obtain a reaction product having an addition ratio of 91% and a saponification value of 675. The reaction product so obtained was saponified in the same manner as in Example 1 to obtain a transparent size having a solids content of 30% and a pH value of 10.8. The thus obtained size was tested for sizing effect in the same manner as in Example 2 with the result that the addition of 0.5% of the size exhibited a sizing degree of 2 seconds.

As is apparent from the foregoing, the use of maleic anhydride in a larger amount than is used in this invention will not result in the production of an excellent size.

EXAMPLE 8

The non-uniform, non-transparent saponified reaction product (final product) having a pH value of 10.5, obtained in the same manner as in Comparative example 5, was allowed to stand whereby it was separated into an oil layer and a water layer. These layers were recovered separately by means of decantation, the water layer being a transparent uniform one and the oily layer being obtained in an amount of about 45 parts.

The solid matter contained in this transparent uniform water layer was found by analysis to have been produced by alkali-saponifying an adduct of 100 parts of the aforesaid distillate with about 27 parts of maleic anhydride.

This water layer was incorporated with water in such an amount as to obtain a size having a solids content of 30%. The size so obtained had excellent storage stability and was tested for sizing effect in the same manner as in Example 2 with the result that the addition of 0.5% of the size exhibited a sizing degree of 25 seconds.

The size obtained in this manner is one exhibiting excellent sizing effect according to this invention.

What is claimed is:

1. A paper size obtained by the steps of:
   treating with an acid a $C_5$ distillate contained in a fraction boiling within the range of 20°-80° C. and containing at least one $C_5$ acyclic conjugated diolefin in an amount of 10-35 wt.% of the distillate, the fraction being obtained as a by-product by thermocracking, a steam cracking or catalytically cracking petroleum, to obtain a hydrocarbon distillate boiling within the range of 170°-400° C. and having a freezing point of not higher than −20° C.,
   reacting 100 parts by weight of the thus obtained hydrocarbon distillate with 25-80 parts by weight of maleic anhydride to obtain a reaction product and then
   saponifying the thus obtained reaction product with an alkali thereby to obtain the size.

2. A paper size according to claim 1, wherein the acid treatment in the first step is effected at 80°-200° C. in the presence of phosphoric acid.

3. A paper size according to claim 1, wherein the acid treatment in the first step is effected at 60°-180° C. in the presence of boron trihalide or a complex compound thereof.

4. A paper size according to claim 1, 2 or 3, wherein said at least one $C_5$ acyclic conjugated diolefin is a member selected from the group consisting of isoprene, trans-1,3-pentadiene and cis-1,3-pentadiene.

5. A paper size according to claim 1, 2 or 3, wherein all the unsaturated components of the distillate in the first step comprises, in addition to said at least one $C_5$ acyclic conjugated diolefin, at least one member selected from the group consisting of monoolefins and other diolefins.

6. A paper size according to claim 4, wherein all the unsaturated components of the distillate in the first step comprises, in addition to said at least one $C_5$ acyclic conjugated diolefin, at least one member selected from the group consisting of monoolefins and other diolefins.

7. A paper size according to claim 5, wherein the monoolefins and other diolefins are 1-pentene, trans-2-pentene, cis-2-pentene, 2-methyl-1-butene, 2-methyl-2-butene, 3-methyl-1-butene, cyclopentene, cyclopentadiene, dicyclopentadiene and 1,4-pentadiene.

8. A paper size according to claim 6, wherein the monoolefins and other diolefins are 1-pentene, trans-2-pentene, cis-2-pentene, 2-methyl-1-butene, 2-methyl-2-butene, 3-methyl-1-butene, cyclopentene, cyclopentadiene, dicyclopentadiene and 1,4-pentadiene.

* * * * *